US006540601B2

(12) United States Patent
Nottingham et al.

(10) Patent No.: US 6,540,601 B2
(45) Date of Patent: Apr. 1, 2003

(54) CASH BOX WITH COIN SORTER

(75) Inventors: John R. Nottingham, Hunting Valley, OH (US); John W. Spirk, Gates Mills, OH (US); William J. Knox, Jr., Painesville, OH (US); Patrick W. Brown, Mantua, OH (US)

(73) Assignee: Mag-Nif Incorporated, Mentor, OH (US)

( * ) Notice: Subject to any disclaimer, the term of this patent is extended or adjusted under 35 U.S.C. 154(b) by 54 days.

(21) Appl. No.: 09/780,191

(22) Filed: Feb. 9, 2001

(65) Prior Publication Data

US 2001/0034202 A1 Oct. 25, 2001

Related U.S. Application Data

(60) Provisional application No. 60/181,952, filed on Feb. 11, 2000.

(51) Int. Cl.[7] ..... G07D 3/04

(52) U.S. Cl. ..... 453/3; 232/62; 109/53

(58) Field of Search ..... 453/3, 9, 14, 44, 453/45, 46; 232/1 D, 14, 15, 16, 64, 62, 55, 43.1, 49; 709/53

(56) References Cited

U.S. PATENT DOCUMENTS

| | | | | | |
|---|---|---|---|---|---|
| 512,959 | A | * | 1/1894 | Hanvey | 453/14 |
| 540,701 | A | | 6/1895 | Taylor | |
| 794,620 | A | | 7/1905 | Hall | |
| 963,200 | A | * | 7/1910 | Andrews | 232/4 R |
| 1,271,339 | A | | 7/1918 | McGinnis | |
| 2,735,541 | A | * | 2/1956 | Mosler | |
| 3,125,104 | A | | 3/1964 | Tryon | 133/5 |
| 3,276,457 | A | | 10/1966 | Edds | 133/5 |
| 3,655,186 | A | | 4/1972 | Bayha | 271/88 |
| 3,814,115 | A | | 6/1974 | Van Acker | 133/4 |
| 4,250,905 | A | | 2/1981 | Kobayashi et al. | 133/5 R |
| 4,332,348 | A | | 6/1982 | Nordin | 232/43.3 |
| 4,374,529 | A | | 2/1983 | Kobayashi et al. | 133/4 A |
| D270,868 | S | | 10/1983 | Spirk, Jr. et al. | D99/35 |
| 4,434,931 | A | | 3/1984 | Hunt et al. | 232/15 |
| 4,593,709 | A | | 6/1986 | Duplessy | 133/3 D |
| 4,607,648 | A | | 8/1986 | Hough | 133/3 D |
| 4,637,326 | A | * | 1/1987 | Baitz et al. | 109/49 |
| 5,011,456 | A | * | 4/1991 | Kobayashi et al. | 453/32 |
| 5,106,337 | A | | 4/1992 | Knox | 453/9 |
| D330,384 | S | | 10/1992 | Knox | D18/3 |
| 5,251,738 | A | | 10/1993 | Dabrowski | 194/206 |
| 5,502,294 | A | | 3/1996 | Yang | 235/7 R |
| 5,829,673 | A | | 11/1998 | Harr, Jr. | 232/15 |
| 5,976,006 | A | | 11/1999 | Snyder | 453/9 |
| 6,006,558 | A | * | 12/1999 | Peters | 109/53 |

FOREIGN PATENT DOCUMENTS

| | | | | |
|---|---|---|---|---|
| GB | 2 225 890 A | * | 6/1990 | G07F/9/04 |
| JP | 4-52797 A | * | 2/1992 | G07G/1/00 |

OTHER PUBLICATIONS

Mag–Nif Makes it in the U.S.A.! Banks, Games & Puzzles, Just for Fun! 1998 Brochure, front and back cover pages and pp. 1–14.

Mag–Nif makes it in the U.S.A.! 1999 Brochure, front and back cover pages and pp. 1–16.

* cited by examiner

*Primary Examiner*—Donald P. Walsh
*Assistant Examiner*—Mark J. Beauchaine
(74) *Attorney, Agent, or Firm*—Fay, Sharpe, Fagan, Minnich & McKee, LLP

(57) ABSTRACT

A cash box includes a housing with a bill storage compartment located in the housing. A coin sorter mechanism is supported by the housing for sorting coins of different denominations. A plurality of coin storage compartments are located in the housing for storing sorted coins. Each coin storage compartment stores coins of a common denomination. The plurality of coin storage compartments communicate with the coin sorter mechanism. The bill storage compartment includes a plurality of sections, each intended to hold a bill of a particular denomination. The housing preferably includes a base which accommodates the plurality of coin storage compartments as well as the coin sorter, and a door which accommodates the several sections of the bill storage compartment. A lift out bill tray may also be accommodated in the door.

31 Claims, 7 Drawing Sheets

CASH BOX WITH COIN SORTER

This application bases its priority on Provisional Application Serial No. 60/181,952 dated Feb. 11, 2000.

The present invention relates to a cash box. More particularly, the present invention relates to a portable cash box having coin sorting features.

BACKGROUND OF THE INVENTION

Portable cash boxes are generally known, as are coin sorters. In a cash box, various compartments are designed to hold varying denominations of currency and varying denominations of coinage. A user places one or more bills or one or more coins in the particular compartment meant to accommodate that denomination of currency or coin. The currency and coins can then be withdrawn from those compartments as needed. In a coin sorting device, a user places one or more coins in a hopper. The hopper is connected to a coin separating mechanism which separates the coins in the coin sorter. Coins of a particular denomination are directed into an appropriate one of a plurality of sorted coin storage containers. When desired, coins can be removed from the sorted coin storage containers, either one at a time or in a stack.

It would be desirable to provide a portable cash box which has coin sorting features so as to allow the ready separation of coins into sorted coin compartments while at the same time allowing currency to be separated into chambers holding various denominations. It would also be desirable to provide a portable cash box which allows the ready dispensing of coins, one at a time, from sorted coin compartments and also allows the removal of all of the coins held in a particular compartment.

It has therefore been considered desirable to develop a new and improved portable cash box with a coin sorter feature which would overcome the foregoing difficulties and others while providing better and more advantageous overall results.

BRIEF SUMMARY OF THE INVENTION

In accordance with the present invention, a cash box is provided.

The cash box comprises a housing and a bill storage compartment located in the housing. A coin sorter mechanism is supported by the housing for sorting coins of different denominations. A motor actuates the coin sorter mechanism. A plurality of coin storage compartments are located in the housing for storing sorted coins. Each coin storage compartment stores coins of a common denomination. The plurality of coin storage compartments communicate with the coin sorter mechanism.

According to another aspect of the present invention, a portable coin and bill storage box is provided.

More particularly in accordance with this aspect of the invention, the box comprises a housing comprising a plurality of walls. A bill storage compartment is located in the housing for accommodating bills. A coin sorter mechanism is supported by the housing for sorting coins of different denominations. A plurality of coin storage compartments are located in the housing for storing sorted coins. Each coin storage compartment stores coins of a common denomination. The plurality of coin storage compartments communicate with the coin sorter mechanism. The housing comprises a base which accommodates the plurality of coin storage compartments and a door which accommodates the bill storage compartment.

According to another aspect of the present invention, a cash box is provided.

More particularly in accordance with this aspect of the invention, the cash box comprises a housing comprising a base portion and a door. A coin sorter mechanism is located in the housing for sorting coins of different denominations. A motor actuates the coin sorter mechanism. A plurality of coin storage compartments are located in the housing for storing sorted coins. Each coin storage compartment stores coins of a common denomination. The plurality of coin storage compartments communicate with the coin sorter mechanism. The door of the cash box can be selectively closed on the base to prevent access to the coin storage compartments.

In accordance with yet another aspect of the present invention, a portable coin and bill storage box is provided.

More particularly in accordance with this aspect of the invention, the box comprises a housing comprising a base and a door. A plurality of bill storage compartments is located in one of the base and the door. A plurality of coin storage compartments is located in one of the base and the door. Each coin storage compartment stores coins of a common denomination. A joint is provided for pivotally mounting the door to the base. When the door is pivoted to a closed position in relation to the base, access is prevented to the plurality of bill storage compartments and to the plurality of coin storage compartments.

One aspect of the present invention is the provision of a new and improved cash box.

Another aspect of the present invention is the provision of a portable cash box having a currency compartment and a coin compartment.

Still another aspect of the present invention is the provision of a cash box having a motorized coin sorting apparatus.

A further aspect of the present invention is the provision of a cash box having a currency compartment which accommodates various denominations of currency in separate receptacles and also accommodates various denominations of coins in separate chambers.

A still further aspect of the present invention is the provision of a cash box having a reciprocating coin pushing mechanism for feeding coins, one at a time, to a coin sorting ramp.

A yet further aspect of the present invention is the provision of a cash box which can be selectively closed and locked and which can be opened to reveal a currency compartment as well as a coin compartment. The currency compartment preferably has a removable tray and the coin compartment preferably includes a transparent front wall to allow a ready counting of the coinage held. Preferably, the front wall can be selectively pivoted down to allow access to a stack of coins held in the compartment.

An additional aspect of the present invention is the provision of a cash box which allows the manual dispensing of coins, one at a time, from coin holding chambers which, respectively, hold coins of varying denominations.

Still other benefits and advantages of the present invention will become apparent to those skilled in the art upon a reading and understanding of the following detailed description.

BRIEF DESCRIPTION OF THE DRAWINGS

The invention may take form in certain components and structures, a preferred embodiment of which will be illustrated in the accompanying drawings and wherein.

DETAILED DESCRIPTION OF THE PREFERRED EMBODIMENT

Figure 1:
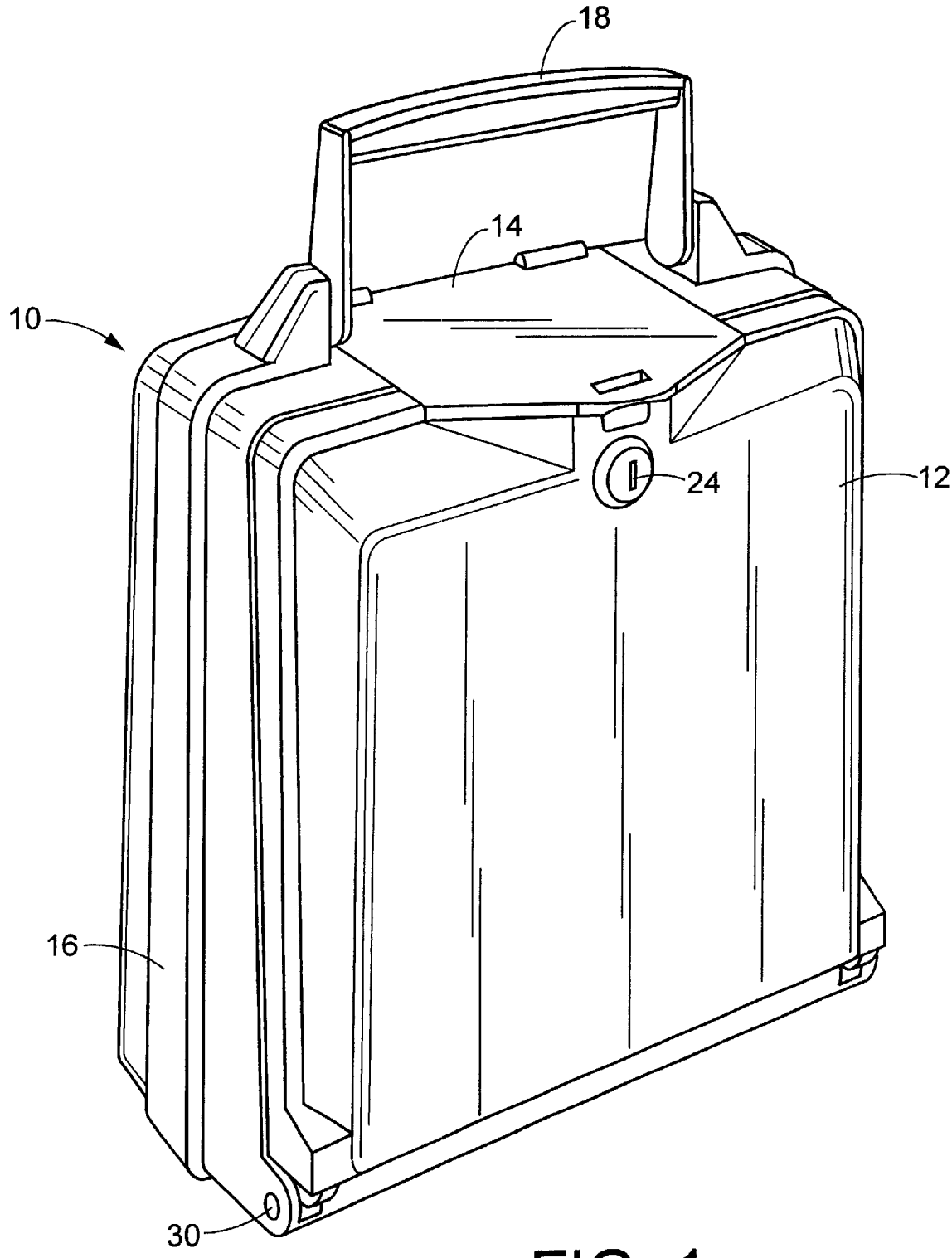
FIG. 1 is a perspective view of a cash box according to a preferred embodiment of the present invention, with the cash box being shown in a closed condition.

Referring now to the drawings, wherein the showings are for purposes of illustrating a preferred embodiment of the invention only and not for purposes of limiting same, FIG. 1 shows a cash box according to the preferred embodiment of the present invention. The cash box includes a housing 10 comprising a door 12 and a lid 14, both pivotally secured on a main case 16 along with a handle 18. Of course, any suitable type of handle-like structure, such as recessed hand grips, can be employed. A lock 24 is used to selectively secure the door 12 in a closed position on the main case 16. It should also be appreciated that the lock 24 can simultaneously serve to secure the lid 14 in a closed position, via a catch 26 (FIG. 3).

Figure 2A:
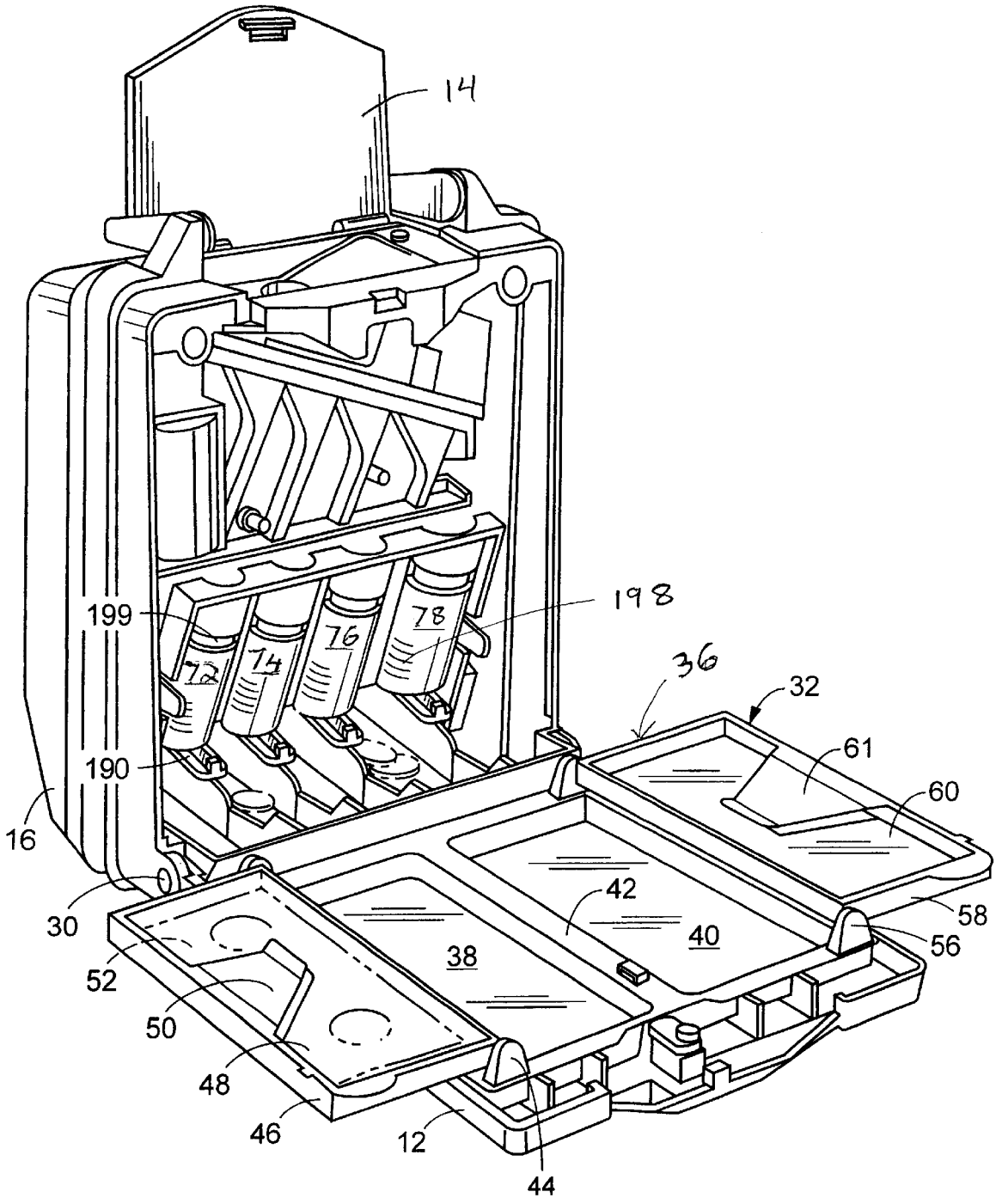
FIG. 2A is a perspective view of the cash box of FIG. 1 in an open condition with a currency tray of the cash box being shown in an unfolded condition.

With reference now also to FIG. 2A, a pair of hinges 30 (only one of which is visible), is used to pivotally mount the door 12 to the main case 16. Defined on an inside surface of the door 12 is a bill compartment 32. Selectively housed in the bill compartment 32 is a removable currency tray 36. The removable tray includes a first bill receptacle 38 and a second bill receptacle 40 which are separated from each other by a divider wall 42. Located along a left edge of the tray 36 are a pair of hinges 44 which pivotally mount a first wing or extension tray section 46. The first extension tray section houses a third bill receptacle 48. A clip 50 extends over a portion of the third bill receptacle 48 in order to prevent bills or currency, such as at 52, from falling out of the third receptacle when it is rotated 180° into its storage position as shown in FIG. 3. Located along an opposite edge of the tray 36 are a pair of second hinges 56 for pivotally mounting a second wing or extension tray section 58. The second extension tray section includes a fourth bill receptacle 60. Overlying a portion of the fourth bill receptacle 60 is a clip 61. As with the first extension tray section 46, the second extension tray section 58 rotates between an open position illustrated in FIG. 2A and a closed position illustrated in FIG. 3. In the closed position, the first extension tray section 46 overlies the first bill receptacle 38 whereas the second extension tray section 58 overlies the second bill receptacle 40. As is evident from FIG. 2A, the removable tray 36 can therefore accommodate currency of four different denominations such as, e.g., 1, 5, and 10 and 20 dollar bills, if the cash box is used with U.S. currency. As shown in FIG. 3, the bill compartment 32 located beneath the removable tray 36 can accommodate 50 and 100 dollar bills, or checks, in a normally hidden manner. To this end, a wall 62 divides the bill compartment into fifth and sixth bill receptacles 63 and 64.

Figure 2B:
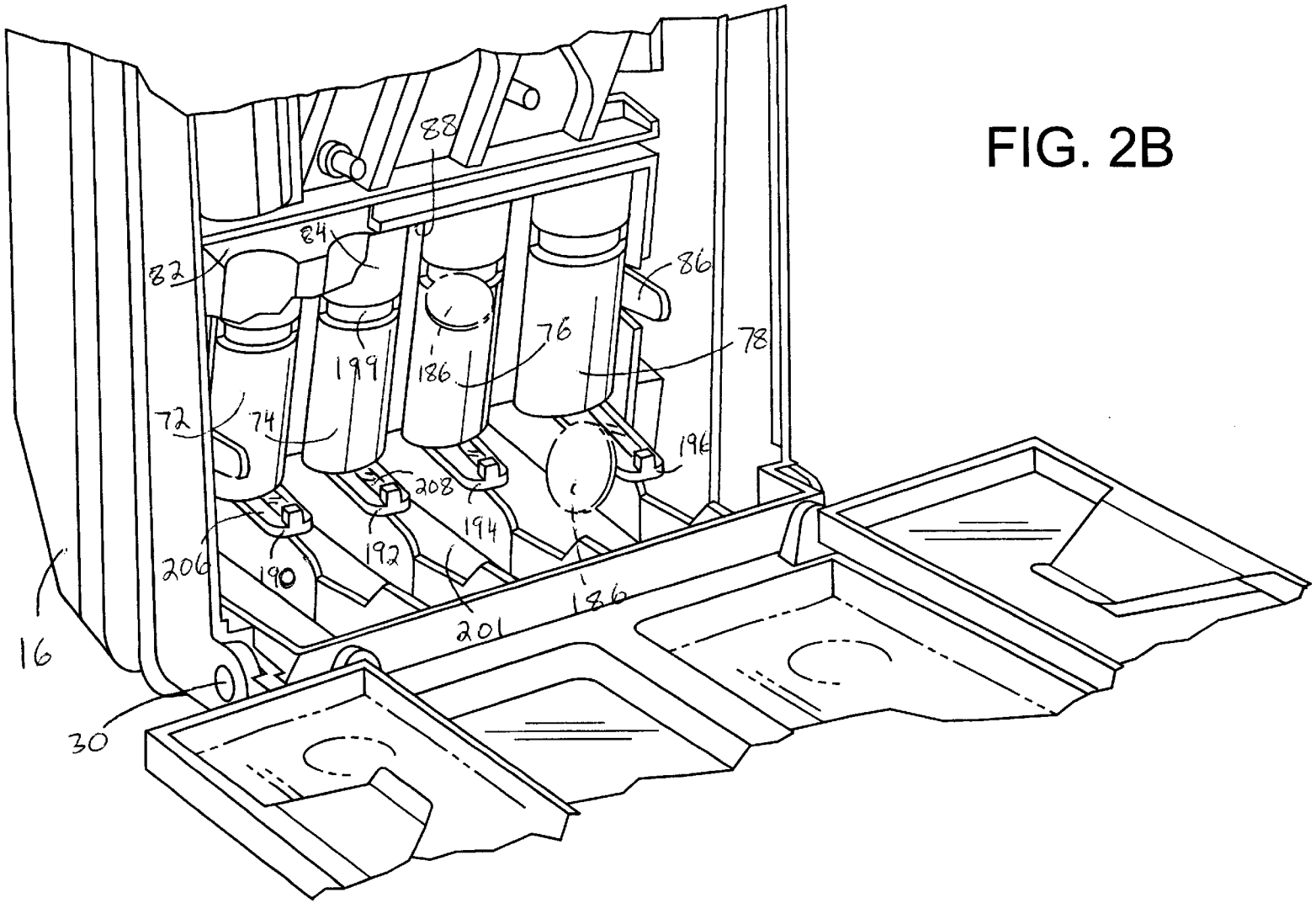
FIG. 2B is an enlarged perspective view of a portion of the cash box of FIG. 2A.
Figure 3:
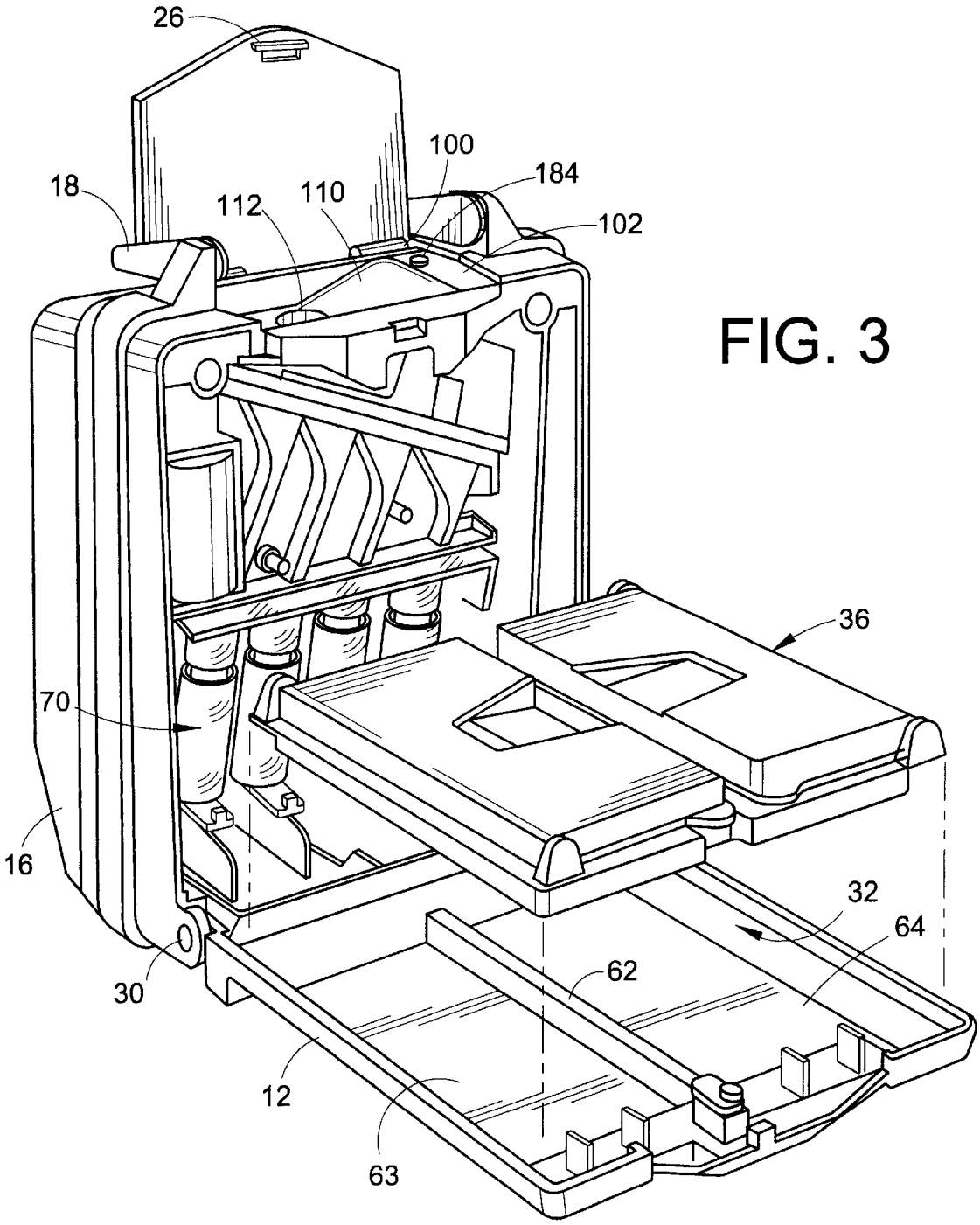
FIG. 3 is a perspective view of the cash box of FIG. 2A with the currency tray being shown in a folded condition and spaced away from a lid of the cash box.

The housing 10 not only comprises a bill compartment 32 but also a coin compartment 70 (FIG. 3). With reference now to FIG. 2B, defined in the coin compartment are four different coin chambers of successively increasing size. If using U.S. coinage, these can be a dimes chamber 72, a pennies chamber 74, a nickels chamber 76, and a quarters chamber 78, as shown in FIG. 2A. These respective chambers are defined between a back wall 82 and a transparent front wall 84. The front wall 84 is pivotally mounted on the main case 16 via hinges (not visible) located adjacent a lower edge of the front wall and locked in a use position by lock members 86. In this way, the front wall 84 can pivot downwardly so as to open the four coin chambers 72, 74, 76, and 78 of the coin compartment 70. The scalloped nature of the front wall 84 defines a hand hold opening 88 along an upper edge of the front wall, so as to allow selective manual manipulation of the front wall. As may be appreciated from FIG. 2A, the front wall 84 is contoured in the same manner as the back wall 82 so as to define substantially cylindrical coin holding chambers 72–78.

With reference again to FIG. 3, a hinge assembly 100 is located along one edge of the lid 14 so as to allow the lid to be selectively rotated from a closed position illustrated in FIG. 1 to an open position shown in FIG. 3. In the open position, access can be had to a top wall 102 of the coin compartment 70. In order to allow the lid 14 to be moved, the handle 18 is rotated from a vertical position, as illustrated in FIG. 1, to a horizontal position as illustrated in FIG. 3.

Figure 4A:
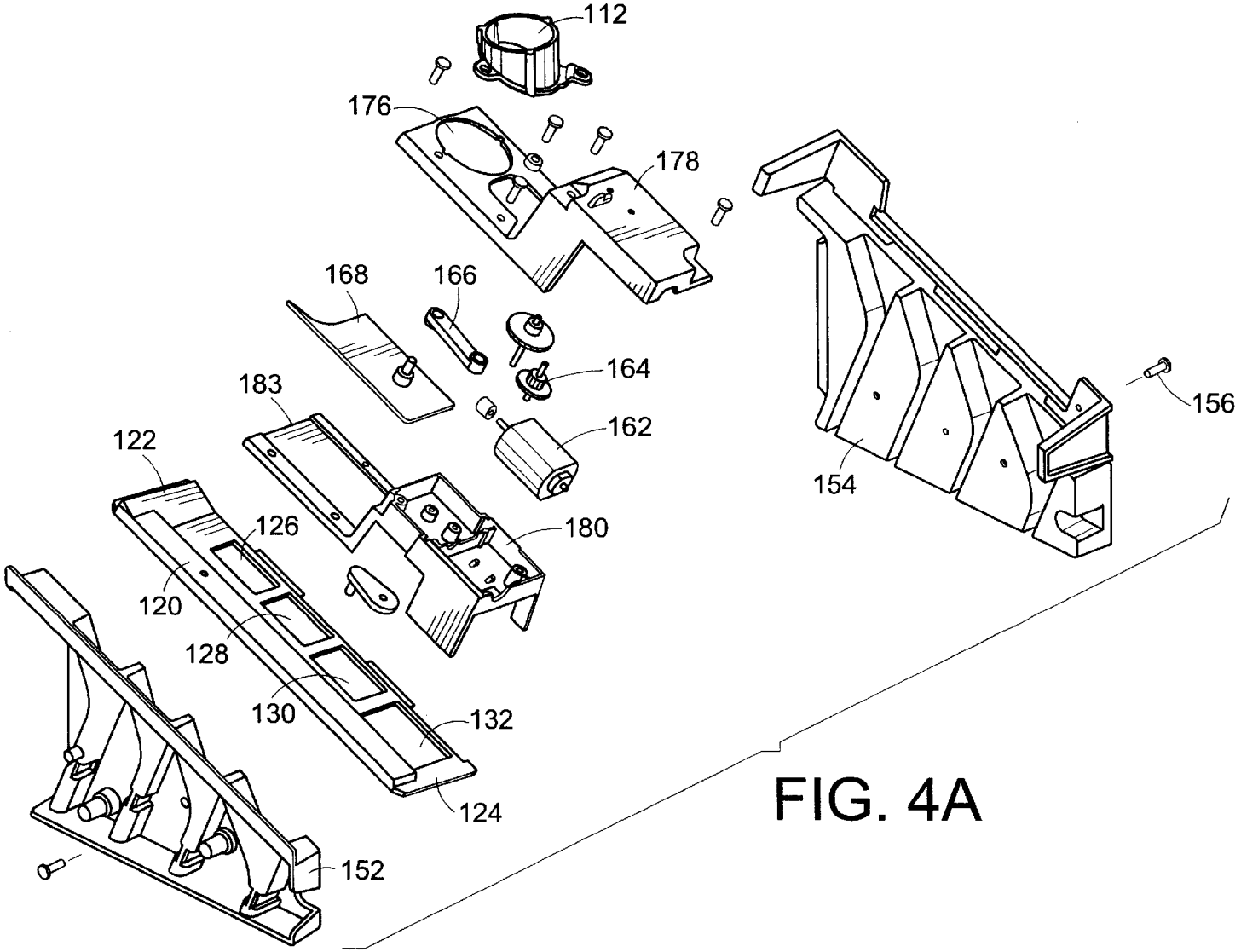
FIG. 4A is an exploded perspective view of a coin sorting apparatus of the cash box of FIG. 1.
Figure 4B:
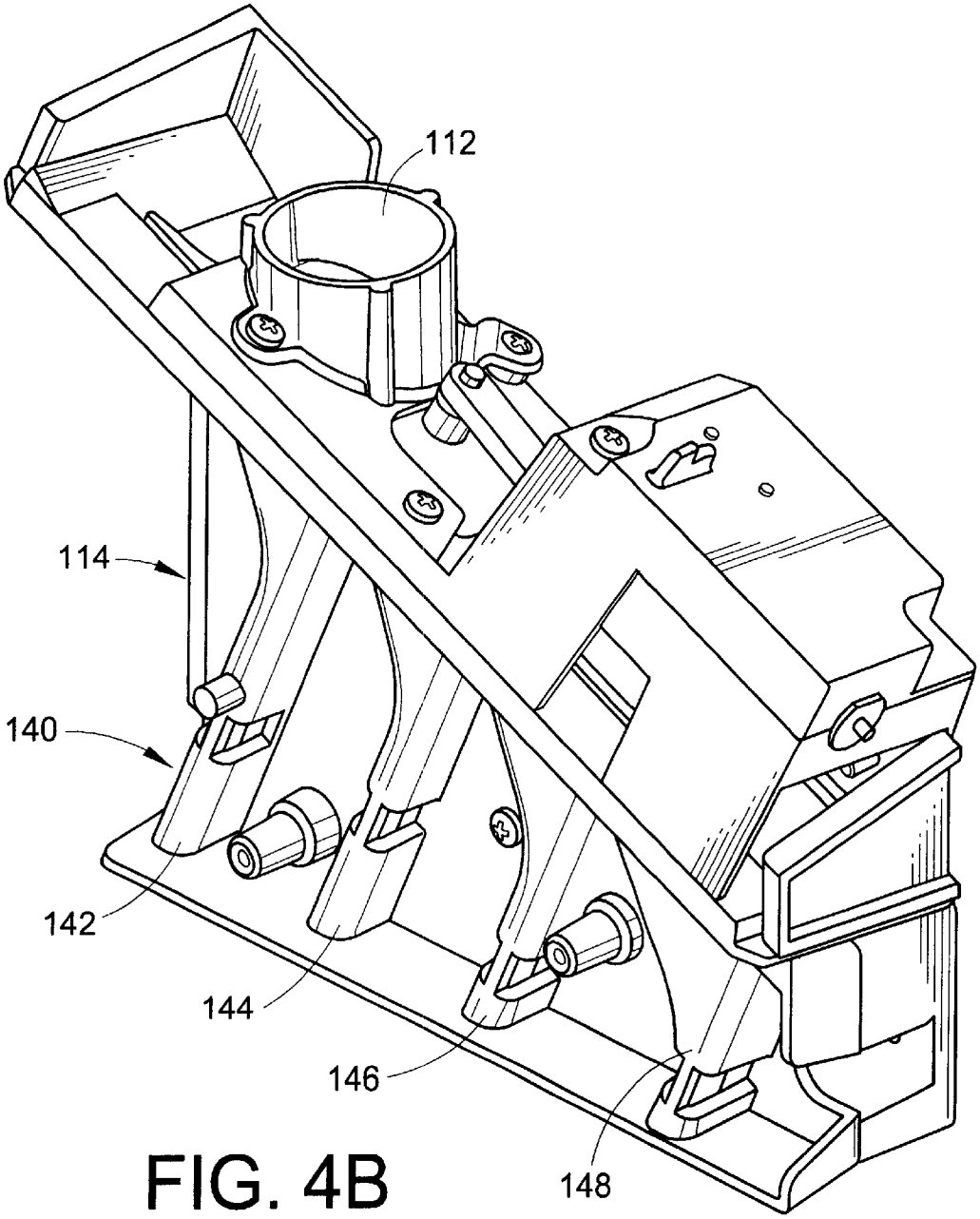
FIG. 4B is an enlarged assembled view of the coin sorting apparatus of FIG. 4A.

A coin funnel 110 is located in the top wall 102. The funnel leads to an inlet aperture 112 which in turn communicates with a coin sorting assembly 114 as illustrated in FIG. 4B. The coin funnel 110 directs unsorted coins deposited therein to the coin sorting assembly 114. The assembly receives unsorted coins and directs each coin to an appropriate one of the plurality of coin chambers 72, 74, 76, 78. With reference now to FIG. 4A, the coin sorting assembly 114 includes a ramp 120 having an upper end 122 and a lower end 124. The ramp is conventional and is disposed within the housing 10 so that it slopes downward from the upper end 122 thereof to the lower end 124 thereof. In this way, coins deposited on the upper end of the ramp 120 slide by gravity downwardly towards the lower end 124. The ramp 120 is made from plastic or another suitable conventional material having a sufficiently low coefficient to friction to allow coins to slide thereon. The ramp 120 is so oriented in the housing 10 that coins will slide thereon in a smooth, uninterrupted fashion at a moderate rate of speed.

The ramp 120 includes a plurality of different sized apertures 126, 128, 130, and 132. The apertures are sized to correspond to the diameter of, respectively, a dime, a penny, a nickel, and a quarter, if U.S. coinage is sorted. The apertures are so sized that only coins smaller than a particular diameter will pass therethrough. By arranging the apertures 126–132 in order of increasing size from the upper end 122 of the ramp to the lower end 124 thereof, the largest coins being sorted will pass over the smaller apertures until they fall through an aperture sized for them. In sum, the ramp 120 will sort coins in accordance with their diameter. The ramp 120 is positioned vertically above a coin chute assembly 140 (FIG. 4B).

Figure 6:
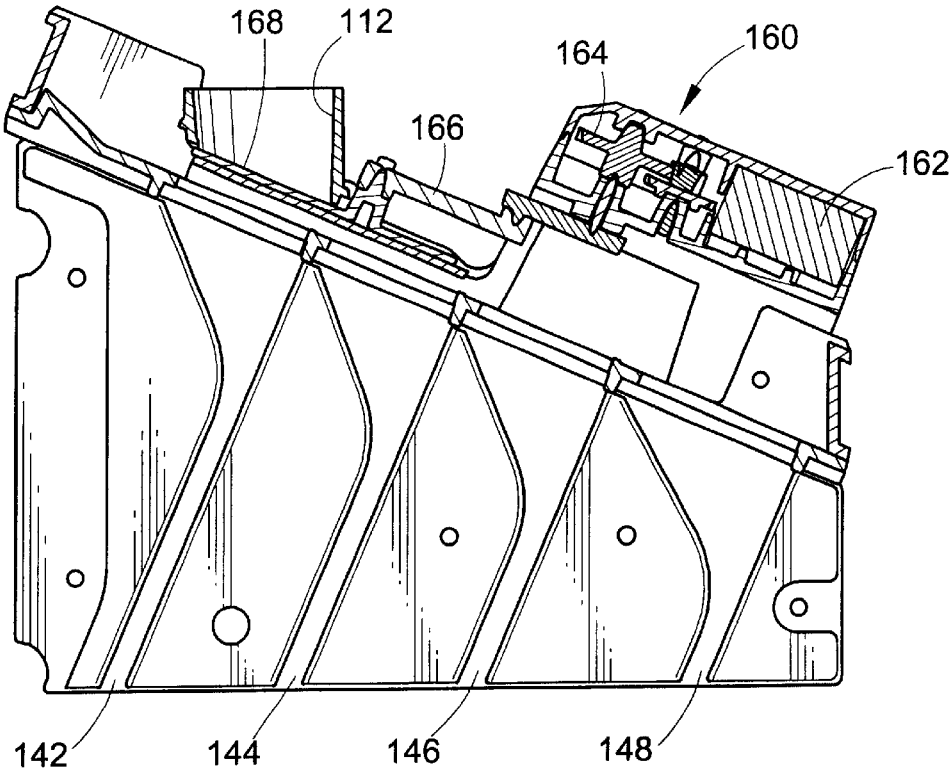
FIG. 6 is a cross-sectional view of the coin sorting apparatus of FIG. 5 along line 6—6.

The coin chute assembly includes four coin chutes 142, 144, 146, and 148 which are respectively sized so as to accommodate coinage of a diameter which can pass through the respective apertures 126, 128, 130, and 132. The coin chute assembly is preferably defined by a front housing portion 152 and a rear housing portion 154 which are connected to each other by suitable conventional fasteners 156. If desired, an adhesive can also be employed for this purpose. Each coin chute 142–148 communicates with a respective one of the coin chambers 72–78. As best illustrated in FIG. 6, the coins fall on edge through the chutes 142–148.

Figure 5:
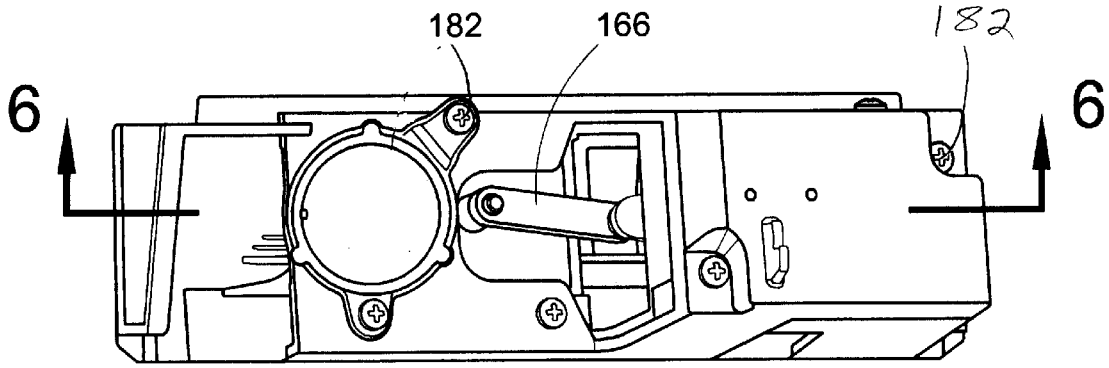
FIG. 5 is an enlarged top plan view of the coin sorting apparatus of FIG. 4B.

The coin sorting assembly also comprises a separator mechanism 160 including a motor 162 having an output shaft connected to a gear train 164. The gear train is connected to a reciprocating arm 166 which, in turn, is connected to a separator plate 168. With reference now again to FIG. 4A, the plate overlies an opening 176 located in a first motor housing half 178. The first motor housing half is, in turn, connected to a second motor housing half 180. The motor 162 and the gearing 164 are mounted between the two housing halves 178 and 180. As is evident from FIG. 5, the arm 166 protrudes out of the first housing half. The entire separator mechanism overlies the ramp 120 as is best illustrated in FIG. 4B. The two housing halves 178 and 180 are secured together by suitable conventional fasteners 182 as illustrated in FIG. 5. Rotation of an output shaft of the motor is transformed into a reciprocating movement of the arm 166 in order to move the separator plate 168 back and forth. With reference again to FIG. 4A, the plate, in turn, strips coins, one at a time, from a stack of coins held in the opening 176 and pushes them off a base wall 183 of the second housing half 180 and onto the upper end 122 of the ramp 120. The arm 166 reciprocates as the motor 162 drives the gear train 164. The motor 162 is selectively actuated by depressing a button 184 (FIG. 3) located on the top wall 102. When the button is depressed, such as by contact with a hand of a user, electrical power from a battery (not illustrated) located in the main case 16 is applied to the motor to operate same.

With reference again to FIG. 2B, coins, as at 186, can be removed individually from the coin compartment 70 by the use of conventional slides 190, 192, 194, and 196. Thus if the cash box is used to make change, a desired slide can be moved forward, against the resistance of a spring (not illustrated) if so desired, so as to singly retrieve e.g. dimes, pennies, nickels, or quarters as desired. Each slide 190–196 is conventional and simply controls the ability of coins one at a time to drop in their respective chambers 72–78. However, when it is desired to retrieve the coins as a stack, the front wall 84 is simply pivoted downwardly. As mentioned, the inner surface of the front wall is contoured so as to form the front portion of each of the respective coin chambers 72–78. The use of a transparent front wall 84 is advantageous from the standpoint that a user of the cash box can readily observe the column of coins held in each of the chambers. If desired, an outer surface of the front wall 84 can be provided with markings 198 (FIG. 2A) to indicate the number of coins, or the total amount of coinage, held in each of the chambers 72–78. Overflow slots 199 can be provided on the front wall 84 defining each of the coin chambers 72–78. The slots enable excess coins 186 to drop into trays 201 located below the coin chambers. The slides 190–196 each have an upper face 206 provided with an angled rib 208 to urge the coins 186 to slide in one side direction and fall into the correct tray 201. While only four coin chambers are illustrated, it should be apparent that five or six coin chambers could also be used if it were desired, for example, to sort half dollar and/or dollar coins.

While in the preferred embodiment, the door 12 is shown as accommodating the bill compartment 32 and the main case 16 is shown as accommodating the coin compartment 70, it should be appreciated that both compartments could be located in the main case, or that some portion of the bill storage function could be pre-formed in the main case. Alternatively, the bill compartment and coin compartment locations could be reversed so that the bill compartment is in the main case with the coin compartment being located in the door. Also, while the main case 16 is shown as being vertically oriented in use while the door is horizontally oriented, it should be appreciated that a horizontal orientation of the main case 16 is also feasible so that the main compartment is oriented in the plane of the door 12 while the cash box is in use, instead of being oriented perpendicular thereto as shown in FIG. 2. Moreover, while the construction illustrated in the Figures has the housing 10 comprising two major components, namely the door 12 and the main case 16 (along with a more minor component namely, the lid 14), any number of components could be employed to form the entire cash box housing.

While the coin sorting assembly 114 is illustrated in the FIGS. as being supported within the housing base portion 12, it should be appreciated that the coin sorter mechanism could be supported by the housing but located outside of the housing, if so desired. While in the preferred embodiment the front wall 84 and back wall cooperate to define the substantially cylindrical chamber 72–78, it should be appreciated that other means for defining such substantially cylindrical chambers could also be employed. It should be appreciated that a removable tray for currency, such as the tray 36, is not necessary to the invention as the extension tray sections 46 and 58 could be simply hingedly mounted to the door 12 if desired. In addition, while hinged mounting of the currency tray wings is illustrated for the tray sections 46 and 58, it should be appreciated that other means of mounting such tray sections, whether to the door 12 or to the removable currency tray 36 could also be employed.

While in the preferred embodiment, a currency compartment 32, including a removable currency tray 36 is illustrated, it should be appreciated that an auxiliary storage compartment could be substituted therefor. More particularly, the auxiliary storage compartment, which could be located on either the door or the base, could accommodate writing instruments, markers, pins, index cards, or other items which may be useful in e.g., conducting a garage sale or in running a charitable bingo game or the like. For example, if the portable cash box were employed in a charitable "Las Vegas night" event, the cash box could accommodate poker chips or the like in addition to change and/or currency.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

What is claimed is:

1. A cash box comprising:

a housing;

a coin sorter mechanism supported by said housing for sorting go coins of different denominations;

a motor for actuating said coin sorter mechanism;

a plurality of coin storage compartments located in said housing for storing sorted coins, each coin storage compartment storing coins of a common denomination, said plurality of coin storage compartments communicating with said coin sorter mechanism, wherein said plurality of coin storage compartments is defined between a rear wall and a front wall, which is selectively movable in relation to said rear wall to provide access to at least one stack of sorted coins; and, an auxiliary storage compartment located in said housing for storing items other than coins.

2. The cash box of claim 1 further comprising:

a dispenser associated with each of said plurality of coin storage compartments; and, a dispensing tray located below each of said plurality of coin storage compartments for holding coins dispensed by a respective dispenser.

3. The cash box of claim 1 further comprising a hand hold defined on said front wall to allow selective manual manipulation of said front wall.

4. The cash box of claim 1 further comprising a lock member for selectively locking the front wall in a use position in relation to the rear wall.

5. A cash box comprising a housing including a base and a door;

a coin sorter mechanism supported by one of said base and said door for sorting coins of different denominations;

a motor supported by one of said base and said door for actuating said coin sorter mechanism;

a plurality of coin storage compartments located in one of said base and said door for storing sorted coins, each coin storage compartment storing coins of a common denomination, said plurality of coin storage compartments communicating with said coin sorter mechanism; and, an auxiliary storage compartment located in one of said base and said door for storing items other than coins.

6. The cash box of claim 5 further comprising a handle mounted to said base.

7. The cash box of claim 5 wherein said coin sorter mechanism and said motor are accommodated in said base.

8. A cash box comprising:

a housing including a base and a door;

a coin sorter mechanism supported by one of said base and said door for sorting coins of different denominations;

a plurality of coin storage compartments located in one of said base and said door for storing sorted coins, each coin storage compartment storing coins of a common denomination, said plurality of coin storage compartments communicating with said coin sorter mechanism;

a funnel located in one of said base and said door which communicates with said coin sorter mechanism; and, a lid which selectively covers said coin funnel, said lid being pivotally mounted on one of said base and said door.

9. The cash box of claim 8 further comprising an auxiliary storage compartment located in one of said base and said door for storing items other than coins.

10. The cash box of claim 8 further comprising a handle mounted to one of said base and said door.

11. A portable coin and bill storage box comprising:

a housing comprising a base and a door;

a bill storage compartment located in one of said base and said door for accommodating bills;

a coin sorter mechanism supported by one of said base and said door for sorting coins of different denominations; and a plurality of coin storage compartments located in one of said base and said door for storing sorted coins, each coin storage compartment storing coins of a common denomination, said plurality of coin storage compartments communicating with said coin sorter mechanism.

12. The box of claim 11 further comprising:

a plurality of dispensers, one associated with each of said plurality of coin storage compartments; and, a plurality of dispensing trays, one located adjacent each of said plurality of dispensers.

13. The box of claim 11 further comprising an auxiliary bill storage compartment selectively mounted to said door.

14. A portable coin and bill storage box comprising:

a housing;

a bill storage compartment located in said housing for accommodating bills;

a coin sorter mechanism supported by said housing for sorting coins of different denominations;

a plurality of coin storage compartments located in said housing for storing sorted coins, each coin storage compartment storing coins of a common denomination, said plurality of coin storage compartments communicating with said coin sorting mechanism;

a cover mounted to said housing for selectively preventing access to said plurality of coin storage compartments; and a handle pivotally mounted to said housing to allow the coin and bill storage box to be easily moved.

15. The box of claim 14 further comprising a coin funnel located in said housing and communicating with said coin sorter mechanism.

16. The box of claim 15 further comprising a lid which selectively covers said coin funnel, said lid being mounted to said housing.

17. The box of claim 14 further comprising a motor for actuating said coin sorter mechanism.

18. The box of claim 14 further comprising an auxiliary storage compartment selectively mounted to one of said housing and said cover.

19. The cash box of claim 14 further comprising a lock for selectively locking said cover to said housing.

20. A portable cash box comprising:

a housing;

a handle mounted to said housing to enable the housing to be easily transported;

a coin sorter mechanism located in said housing for sorting coins of different denominations;

a plurality of coin storage compartments located in said housing for storing sorted coins, each coin storage compartment storing coins of a common denomination, said plurality of coin storage compartments communicating with said coin sorter mechanism, wherein said housing can be selectively closed to prevent access to said plurality of coin storage compartments;

a coin funnel located in said housing and communicating with said coin sorter mechanism; and, a lid which selectively covers said coin funnel, said lid being mounted on said housing.

21. The cash box of claim 20 further comprising a dispenser associated with each of said plurality of coin storage compartments.

22. The cash box of claim 21 further comprising a dispensing tray located below each of said plurality of coin storage compartments for holding coins dispensed by a respective dispenser.

23. A portable cash box comprising:

a housing including a base and a door;

a coin sorter mechanism located in one of said base and said door for sorting coins of different denominations;

a plurality of coin storage compartments located in one of said base and said door for storing sorted coins, each coin storage compartment storing coins of a common denomination, said plurality of coin storage compartments communicating with said coin sorter mechanism; and a lock for selectively locking said door to said base to prevent access to said plurality of coin storage compartments.

24. The cash box of claim 23 further comprising:

a coin funnel located in one of said base and said door, and communicating with said coin sorter mechanism; and a lid which selectively covers said coin funnel, said lid being mounted on one of said base and said door.

25. The cash box of claim 24 wherein said lid comprises a lock element which cooperates with said lock to secure said lid in a closed position on said one of said basee and said door.

26. A portable coin and bill storage box comprising:

a housing comprising a base and a door;

a plurality of bill storage compartments located in one of said base and said door;

a plurality of coin storage compartments located in one of said base and said door for storing coins, each coin storage compartment storing coins of a common denomination;

a coin sorter secured to one of said base and said door and communicating with said plurality of coin storage compartments; and, a connection for mounting said door to said base, wherein, when said door is moved to a closed position in relation to said base, access is denied to said plurality of bill storage compartments and said plurality of coin storage compartments.

27. The box of claim 26 further comprising an auxiliary storage compartment selectively mounted to one of said base and said door.

28. The box of claim 27 wherein said auxiliary storage compartment comprises at least one extension tray movably mounted to said auxiliary storage compartment.

29. The box of claim 28 further comprising a finger associated with said at least one extension tray, said finger holding an associated bill in place in said at least one extension tray.

30. The box of claim 29 wherein said at least one extension tray overlays said auxiliary storage compartment in one orientation of said at least one extension tray.

31. The box of claim 26 further comprising a lock for selectively locking door to said base to prevent access to said plurality of coin storage compartments and said plurality of bill storage compartments.

* * * * *